US007393290B2

(12) United States Patent
Martin et al.

(10) Patent No.: US 7,393,290 B2
(45) Date of Patent: Jul. 1, 2008

(54) SPORT BALL STORAGE AND RETRIEVAL APPARATUS

(75) Inventors: Aloysius Ignatlus Martin, Philadelphia, PA (US); David Charles Curry, Philadelphia, PA (US)

(73) Assignee: Swishy, LLC, Philadelphia, PA (US)

( * ) Notice: Subject to any disclaimer, the term of this patent is extended or adjusted under 35 U.S.C. 154(b) by 0 days.

(21) Appl. No.: 11/453,325

(22) Filed: Jun. 14, 2006

(65) Prior Publication Data

US 2007/0293355 A1 Dec. 20, 2007

(51) Int. Cl.
*A63B 69/00* (2006.01)

(52) U.S. Cl. ..... 473/422; 473/431; 473/451

(58) Field of Classification Search ..... 473/422, 473/431, 451, 447, 433; D6/552; 124/45
See application file for complete search history.

(56) References Cited

U.S. PATENT DOCUMENTS 3,319,797 A * 5/1967 Felstehausen ..... 211/15
3,606,022 A * 9/1971 Beesley, Jr. ..... 211/59.2
3,917,263 A 11/1975 Wiley
4,282,848 A * 8/1981 Kulesza et al. ..... 124/16
5,310,176 A * 5/1994 Berg ..... 473/433
5,335,794 A 8/1994 Reedy
5,351,976 A 10/1994 Penson
D365,716 S * 1/1996 Rose, Sr. ..... D6/552
5,746,668 A * 5/1998 Ochs ..... 473/433
5,980,399 A * 11/1999 Campbell et al. ..... 473/459
6,056,652 A * 5/2000 Lees et al. ..... 473/433
D457,767 S * 5/2002 Schumacher ..... D6/552
6,679,794 B1 * 1/2004 Vitello et al. ..... 473/433
6,949,034 B2 9/2005 Vitello
D540,409 S * 4/2007 Martin et al. ..... D21/720
2004/0038756 A1 * 2/2004 Brophy ..... 473/451

OTHER PUBLICATIONS www.onlinesports.com; website showing three and four tier basketball racks; copies of web page printout attached, 1995-2006.

* cited by examiner

*Primary Examiner*—Mitra Aryanpour
(74) *Attorney, Agent, or Firm*—Robert Axenfeld; Montgomery, McCracken Walker & Rhoads

(57) ABSTRACT

A combination of a ball storage rack and a ball feeder track provide an apparatus for basketball storage and consistent position retrieval of sport balls, such as basketballs and volleyballs, by a player. The apparatus comprises a frame configured with an upper portion along the length of the frame capable of holding a plurality of sport balls with a lower rack configured to hold a plurality of sport balls and an extendable feeder track capable of receiving a sport ball and facilitating movement of the sport ball down the track for retrieval of the sport ball by a player. Feeder track may be extended for use in active sports drills or sport games, or folded or retracted for convenient storage of the apparatus when not in use. Apparatus may be configured to hold and display signage such as advertisements.

4 Claims, 5 Drawing Sheets

SPORT BALL STORAGE AND RETRIEVAL APPARATUS

TECHNICAL FIELD

The present invention relates generally to the storage of sport balls, such as basketballs or volleyballs, and providing easy retrieval of sport balls when engaged in sports activities.

BACKGROUND

Sport balls are generally stored on a tiered storage rack made of a steel frame or other rigid material, with side supports that hold sport balls securely in place. Many commercially available storage racks are also portable, allowing the rack to be moved about for convenience. Racks of sport balls are often positioned about on a basketball court or a volleyball court for use in individual or team practice, training, or for use in games. Storage racks can be two or three tiered, or more, and hold a plurality of sport balls. However, while these racks are ideal for storage of balls, they are not as useful for players actively engaged in practice drills, such as shooting, passing, spiking, or other drills.

Commercially available storage racks are not equipped to aid in dispensing balls when players are actively engaged in practice or team play. A player, coach, or other assistant, must retrieve a ball from the rack, which can be awkward in rapid successive activities such as free throw shooting or passing drills. A player, coach, or other assistant, must remove a ball each time and many times from different shelves on the rack, which may involve successive bending down to retrieve balls from lower racks, thereby impeding immediate retrieval and release of the ball for fast-paced drills. No storage rack provides both storage of sport balls while allowing a player or coach to remain in position in close proximity to the rack and retrieve a sport ball in rapid succession at a level that does not involve bending-down and looking at the rack to retrieve the ball.

SUMMARY

Described herein is an apparatus for storage and consistent positional retrieval of sport balls. The invention is a combination of a ball storage rack and a ball feeder track, which provide a system for basketball storage and consistent position retrieval of sport balls by a player. The invention is also a ball storage and retrieval apparatus for use in basketball practice, drills, games or tournament play.

The combination of storage rack and feeder track allows for improved practice sessions for sports such as basketball and volleyball. A basketball player using the storage and retrieval apparatus will be able to participate in fast paced drills, while a volleyball player will be able to practice shots or other drills in rapid succession.

The storage rack portion of the apparatus securely stores sport balls, while the novel combination of a feeder track to the upper portion of the storage rack and positioned at an upward angle relative to the upper portion, thereby creating a ball chute, whereby balls that are placed at or near the highest end of the feeder track roll down the track and onto the upper portion of the frame of the apparatus. Several balls may be placed on the feeder track in succession until the upper portion of the frame and the feeder track are filled with balls. When a player removes a ball from the end of the upper portion of the frame opposite the feeder track, the balls will roll forward and a new ball will remain in position ready for retrieval by the player, a new player, a coach or other assistant.

As balls are collected by players, coaches or other assistants, they may be continuously placed at or near the highest end of the feeder track, thereby providing a constant influx of balls. As balls are replenished onto the feeder track, movement of the balls along the track and onto the upper portion of the frame provides for consistent positional retrieval of balls by a player at the end of the upper portion of the frame opposite the feeder track.

The simple design allows for single person operation; the same player can retrieve balls from the upper portion of the frame for play and replenish balls by returning balls that have been used in drills to the feeder track. Alternatively, the apparatus allows for multi-persons use; a coach or other assistant may return previously used balls to the feeder track, thereby allowing players to remain at the receiving end of the upper portion to retrieve a ball and continue in active play.

The sport ball storage and retrieval apparatus has a frame configured with a lower storage rack and an arcuate upper portion that holds balls that have been fed from the feeder track. The feeder track is attached to the frame by a hinge, thereby allowing the feeder track to fold onto the upper portion, covering the upper portion and making the apparatus easy to store. The frame is equipped with wheels so that the apparatus may be wheeled about a court or other practice area. An optional clear plastic or Plexiglas panel can be attached on a surface of a side of the frame so that advertisements or team graphics can be displayed.

The novel sport ball storage and retrieval apparatus functions as a practice tool for players and coaches, by providing consistent positional retrieval of balls from a receiving end of the upper portion of the frame. The apparatus also functions as a portable storage rack, thereby eliminating the need for separate practice aids and storage racks.

BRIEF DESCRIPTION OF THE DRAWINGS

The detailed description is explained with reference to the accompanying figures. In the figures, the left-most digit(s) of a reference number identifies the figure in which the reference number first appears.

DETAILED DESCRIPTION

Described herein is a novel sport ball storage and retrieval rack that provides consistent positional retrieval of a sport ball, such as a basketball or volleyball.

Figure 1:
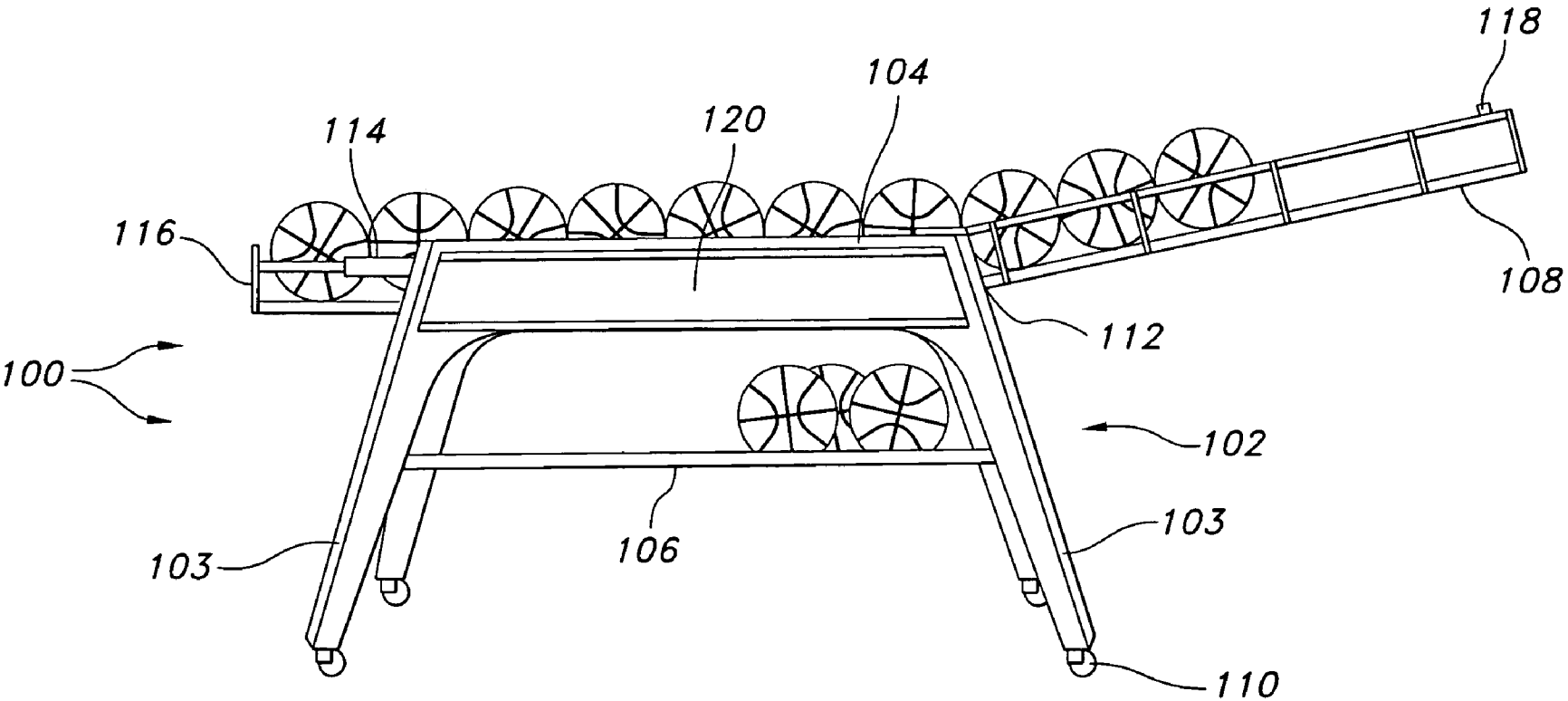
FIG. 1 shows a side view of the basketball storage & retrieval apparatus with the feeder track in the extended position.

FIG. 1 shows an apparatus 100 for providing consistent positional retrieval of a sport ball, comprising a frame 102 having vertical support members 103, the frame 102 configured with an upper portion 104 along the length of the top of frame 100 configured to hold a plurality of sport balls; a lower rack 106 configured to hold a plurality of sport balls connected to the vertical support members 103 of the frame 102; an extendable feeder track 108 connected to the upper portion 104 of the frame 102, capable of receiving a sport ball and facilitating movement of the sport ball down the track 108 and onto the upper portion 104 of the frame 102 for retrieval of the sport ball by a player.

In one implementation, support members 102 are four vertical legs extending to make contact with the floor and provide stationary support for the frame. In another implementation, support members 102 are equipped with wheels 110 as to make the apparatus 100 portable.

In one implementation, lower rack 106 extends horizontally beneath the frame 102 and is attached at each end to support members 102. In one implementation, lower rack 106 is configured as a single rack extending the length of the frame. In another implementation, lower rack 106 can be configured as a double rack to allow for storage of two rows of sport balls on lower frame 106, either side by side or as one row positioned on top of another row.

Apparatus 100 allows for consistent positional retrieval of a sport ball when the feeder track 108 is positioned at an upward angle relative to the upper portion 104 of frame 102. In one implementation, feeder track 108 is configured with a concave surface such that when a sport ball is placed at the highest most end of feeder track 108 in the extended position, the sport ball rests on the concave surface of feeder track 108 and gravitational movement propels the sport ball down the track 108 and onto the upper rack 104 of frame 102.

Feeder track 108 may be extendable, such that the length of the track is adjustable. In one implementation, feeder track 108 is telescopic and can be positioned at a desired length for moving balls along the track 108 and onto the upper portion 104. (shown in more detail in FIGS. 4*a* and 4*b*) In another implementation, the feeder track is extendable by engaging hinged portions along the length of the feeder track 108. (shown in more detail in FIGS. 5*a* and 5*b*)

In one implementation, feeder track 108 has a length equivalent to the length of the upper rack 104, but may be shorter or longer than the length of upper rack 104. In one implementation, feeder track 108 is connected to frame 102 by a hinge 112 or other appropriate means of securing the feeder track 108 to frame 102.

Figure 2:
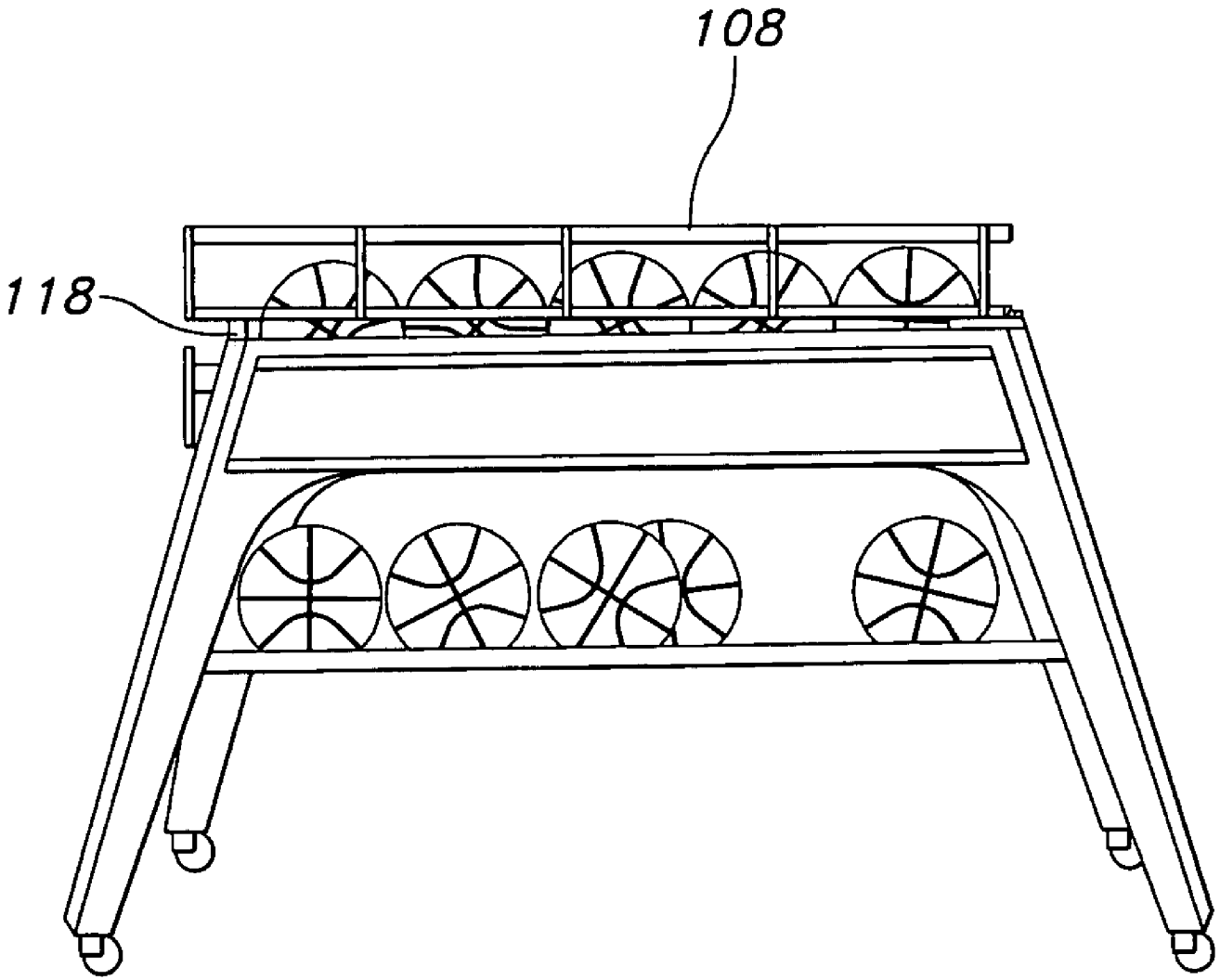
FIG. 2 illustrates a side view of the basketball storage & retrieval apparatus with the feeder track.

In yet another implementation, feeder track 108 is configured such that the track can folded onto the upper portion 104, thereby interfacing the upper portion 104 and securing any sport balls on the upper portion 104 for storage, as shown in FIG. 2.

In one implementation, a player engaged in active drills, such as free throw shooting, is able to retrieve a sport ball, such as a basketball, from a retrieval end 114 of the upper rack 104 of apparatus 100 in rapid succession. A constant stream of basketballs is available as the player, a second player or a coach, returns balls to the feeder track 108, which moves balls into position on the upper rack 104 for retrieval at retrieval end 114. A coach or other assistant, is able to retrieve a ball from upper rack 104 and pass the ball to a plurality of players, while placing returned balls onto feeder track 108.

In one implementation, frame 102 is configured with a retractable member 116 at retrieval end 114 that functions to extend the upper portion 104 of frame 102. Retractable member 116 is configured such that it is capable of holding at least one sport ball for retrieval by a player. In one implementation, retractable member 116 is configured such that it slides in and out on a track, similar to a drawer.

In another implementation, retractable member 116 is configured with a safety mechanism (not shown in Figures) such that movement of the retractable member 116 is stopped when an object, such as the hand of a player, is placed between the retractable member 116 and the frame 102, thereby preventing injury. Suitable safety mechanisms include padding or other suitable material to prevent the retractable member 116 from coming into close contact with frame 102 such that the hand of a player could become caught between the member 116 and the frame 102.

When it is desired to store sport balls securely for future use, feeder track 108 may be placed over upper rack 104 such that feeder track 108 interfaces upper rack 104, as shown in FIG. 2. In one implementation, feeder track 108 is folded back onto the frame 102 by rotation about a hinge 112 or other appropriate attachment mechanism. In another implementation, feeder track 108 may be configured with a safety mechanism 118 comprised of padding on at least a portion of the feeder track 108 as to prevent injury, such as pinching of fingers, when the feeder track 108 is folded back onto the frame 102. Safety mechanism 118 may be any suitable length or thickness of padding or other suitable material that functions to prevent tight closure of feeder track 108 upon upper rack 104. In one implementation, safety mechanism is a circular rubber bumper that is attached near the distal end of feeder track 108 and creates a gap of several inches between the feeder track 108 and upper rack 104 upon interface, as shown in FIG. 2.

In one implementation, frame 102 may be configured in such a way as to allow signage, such as advertisements or announcements, to be attached to frame 102 for display. Advertisements, announcements or other signage can be displayed by a placard 120 on a side surface of frame 102. Placard 120 may be attached to a side surface of frame 102 as shown in FIG. 1 and FIG. 2 in a manner such that the placard 120 is permanently fixed to the apparatus 100. In another implementation, placard 120 may be attached in a manner such that placard 120 is removable from frame 102 of apparatus 100. Placard 120 may be comprised of wood, Plexiglas, plastic or any other suitable material. Placard 120 may be of various shapes and sizes and may accommodate a variety of signage, for example, a banner displaying the name of a corporate sponsor for a basketball tournament.

Figure 3:
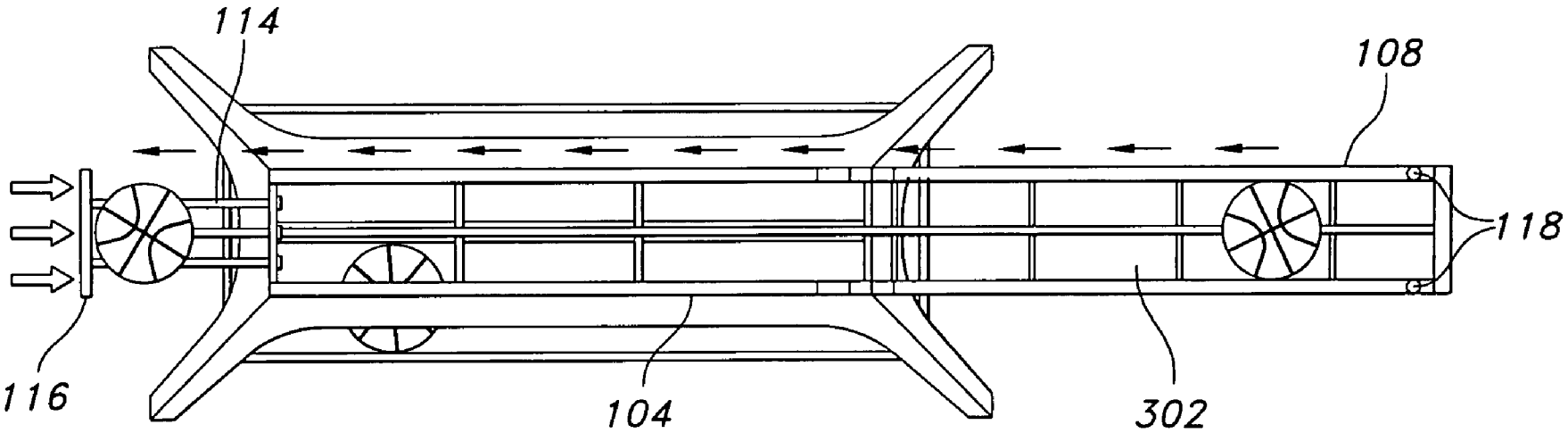
FIG. 3 shows a top view showing the upper rack and the feeder track of the basketball storage and retrieval apparatus.

FIG. 3 shows a top view of frame 102 and an arcuate surface 302 of feeder track 108 and upper portion 104 that allows the track 108 and upper portion 104 to accept a sport ball such as a volleyball or basketball. Arcuate surface 302 provides a surface that accepts and cradles sport balls while facilitating movement along the track 108 when the track 108 is positioned at an upward angle relative to the upper portion 104 of frame 102. In another implementation, the surface may be level, or configured in any way that allows a sport ball to roll down the feeder track 108 and onto the upper portion 104.

Figure 4A:
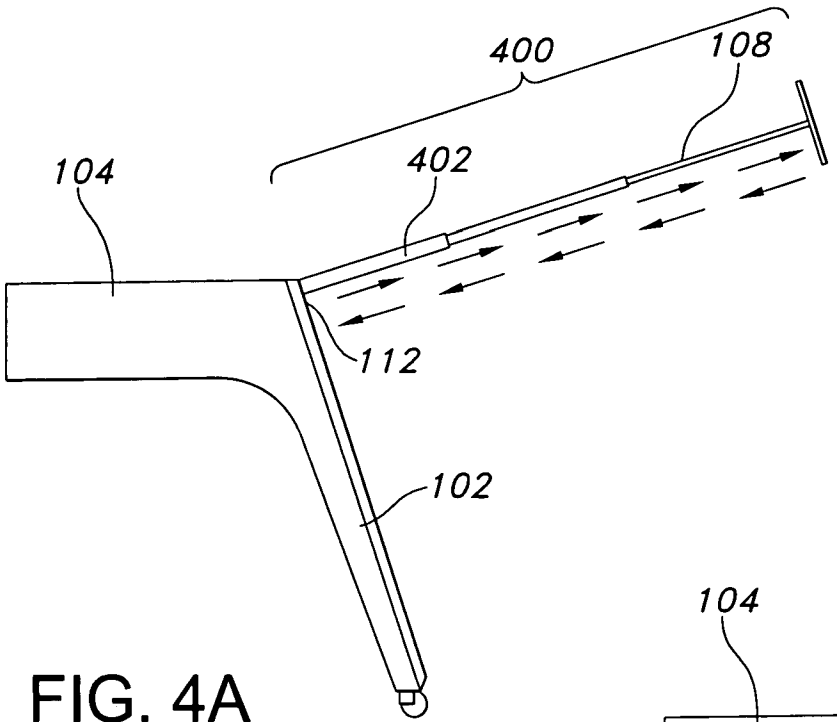
FIGS. 4*a* and 4*b* shows a telescopic feeder track extended for use (see FIG. 4*a*) and contracted for convenient storage of apparatus (see FIG. 4*b*).
Figure 4B:
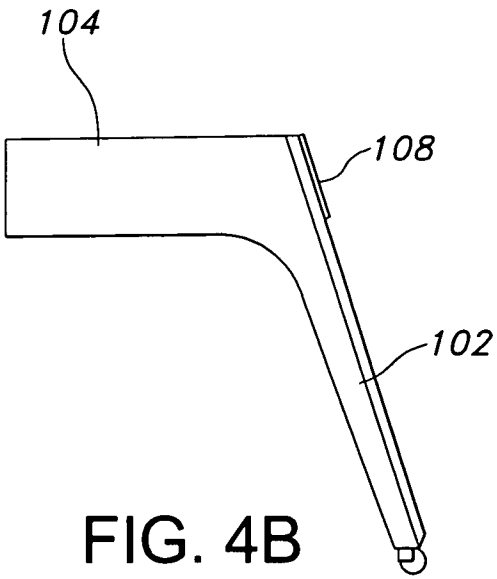
Figure 5A:
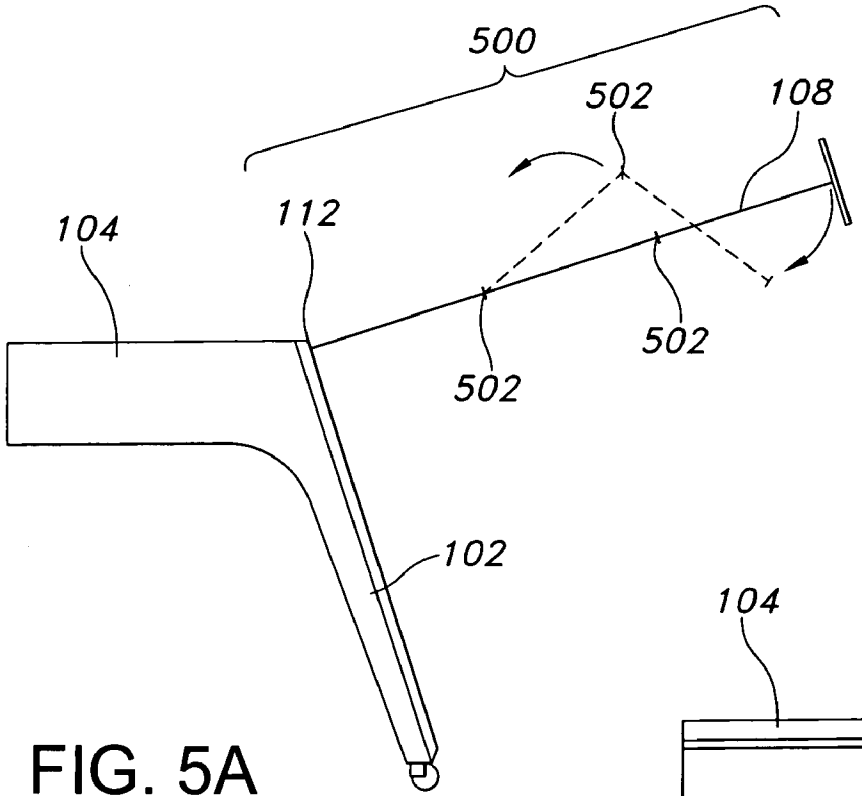
FIGS. 5*a* and 5*b* shows a hinged feeder track extended for use (see FIG. 5*a*) and contracted for convenient storage of apparatus (see FIG. 5*b*).
Figure 5B:
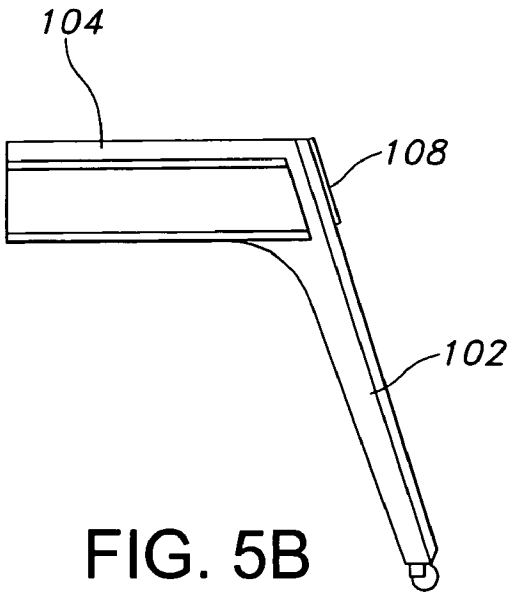

FIGS. 4*a* and 4*b* and FIGS. 5*a* and 5*b* show further implementations on configuration of feeder track 108. FIG. 4*a* shows a telescopic feeder track 400. Telescoping members 402 allow the feeder track 108 to be positioned at a desired length. Telescoping members 402 are attached to frame 102 at an attachment point 112 such as a hinge. Telescoping members 402 slide in and out and may be secured in a position at the desired length of feeder track 108. FIG. 4*b* shows that when feeder track 108 is not in use, telescoping members 402 may be positioned such that the telescopic feeder track 400 is retracted to a shortest position and folded down along the side of frame 102 for convenient storage.

FIG. 5*a* shows a hinged feeder track 500 that allow feeder track 108 to be extended by engaging hinges 502 at various positions along the track. When not in use, hinges 502 are disengaged and the hinged feeder track 500 is contracted in an accordion fashion and folded down along the side of frame 102 at the attachment point 112 for convenient storage.

The embodiments described herein are to be considered in all respects only as exemplary and not restrictive. The scope of the invention is, therefore, indicated by the subjoined Claims rather by the foregoing description. All changes which come within the meaning and range of equivalency of the Claims are to be embraced within their scope.

What is claimed is:

1. An apparatus for providing consistent positional retrieval of a sport balls, comprising:

a frame having at least one vertical support member, the frame configured with an upper portion along the length of the frame and capable of holding a plurality of sport balls, the upper portion having first and second ends;

an extendable-feeder track connected to the upper portion of the frame proximal to the second end, the extendable-feeder track having ocean and closed positions relative to the upper portion of the frame, wherein when the extendable-feeder track is in an open position, the extendable feeder track is capable of receiving a sport ball and facilitating movement of the sport balls down the extendable-feeder track and onto the upper portion of the frame for retrieval of the sport balls by a player at the first end of the upper portion of the frame, wherein when the extendable-feeder track is in an open position, the extendable-feeder track extends beyond the upper portion of the frame and is connected to the upper portion of the frame at an angle, thereby allowing for gravitational movement of the plurality of sport balls down the extendable-feeder track and onto the upper portion of the frame;

an attachment mechanism, connecting the extendable-feeder track to the frame proximal to the second end of the upper portion of the frame, the attachment mechanism configured to permit the extendable-feeder track to pivot, around an axis, to and from the open and closed positions; and a vertical member, located proximal the first end of the upper portion of the frame, configured to stop the soil balls from rolling past the first end of the frame, whereby when a plurality of sports balls are placed on the upper portion of the frame and the extendable-feeder track in a succession, and when a single sports ball is removed from the first end of the frame, the remaining plurality of sport balls roll forward with a next successive s oils ball In position ready for retrieval, and whereby movement of the sports balls along the extendable-feeder track and onto the upper portion of the frame provides for the consistent positional retrieval of balls from the first end of the upper portion of the frame.

2. The apparatus of claim 1, wherein the sport ball is a volleyball or basketball.

3. The apparatus of claim 1, further comprising wheels attached to support members to provide transport of apparatus.

4. The apparatus of claim 1, configured with a placard to accept and display signage such as advertisements or announcements.

* * * * *

UNITED STATES PATENT AND TRADEMARK OFFICE

CERTIFICATE OF CORRECTION

PATENT NO. : 7,393,290 B2
APPLICATION NO. : 11/453325
DATED : July 1, 2008
INVENTOR(S) : Aloysius Ignatius Martin and David Charles Curry It is certified that error appears in the above-identified patent and that said Letters Patent is hereby corrected as shown below:

On the title page, item (75), the name of the first inventor reads: "Aloysius Ignatlus Martin"; please correct this to read: --Aloysius Ignatius Martin--.

Signed and Sealed this

Eighteenth Day of August, 2009

David J. Kappos

David J. Kappos
*Director of the United States Patent and Trademark Office*